US005242350A

United States Patent [19]

Chang

[11] Patent Number: 5,242,350

[45] Date of Patent: Sep. 7, 1993

[54] ADJUSTABLE DUMBBELL

[76] Inventor: Sreter Chang, 451 Ta Tien Road, Homei Chen, Changhau, Taiwan

[21] Appl. No.: 976,190

[22] Filed: Nov. 13, 1992

[51] Int. Cl.[5] ..... A63B 21/072

[52] U.S. Cl. ..... 482/108; 482/105; 482/93

[58] Field of Search ..... 482/107, 108, 92, 93, 482/106, 148, 908, 104, 109, 44, 49, 105

[56] References Cited

U.S. PATENT DOCUMENTS

| | | | |
|---|---|---|---|
| 850,964 | 4/1907 | Pelletier et al. | 482/108 |
| 4,351,526 | 9/1982 | Schwartz | 482/108 |
| 4,720,098 | 1/1988 | Gordon | 428/108 |
| 4,743,017 | 5/1988 | Jaeger | 482/108 |
| 5,033,740 | 7/1991 | Schwartz et al. | 482/106 |
| 5,090,693 | 2/1992 | Liang | 482/108 |
| 5,135,454 | 8/1992 | Yeh | 482/108 |
| 5,135,455 | 8/1992 | King et al. | 482/108 |
| 5,180,352 | 1/1993 | Sreter | 482/93 |

*Primary Examiner*—Stephen R. Crow
*Assistant Examiner*—Jerome Donnelly
*Attorney, Agent, or Firm*—James P. Hanrath; Thomas R. Vigil

[57] ABSTRACT

An adjustable dumbbell is disclosed consisted of a revolving shaft clamped with a clamping plate and coupled to a solid rod inserted in a tube, a catch pivotally connected to the tube at one end to hold down the solid rod, a cover sleeve sleeved on the tube, a guard adjustably fastened to the cover sleeve, two weights fastened to the tube at two opposite ends, two sockets respectively mounted on the weights, and two end caps respective fastened to the sockets to hold counter weights.

1 Claim, 4 Drawing Sheets

ADJUSTABLE DUMBBELL

BACKGROUND OF THE INVENTION

1. Field of the Invention

The present invention relates to dumbbells and relates more particularly to a dumbbell which can be conveniently adjusted to change its weight.

2. Description of Prior Art

A dumbbell generally has a short bar of wood or iron with heavy ends, used in exercising the arms. This structure of dumbbell has a fixed total weight once it was made. Because the total weight is not adjustable, different dumbbells may have to be used by different persons according to respective amount of exercise. There is disclosed a weight adjustable dumbbell which can be adjusted to change the weight according to different requirements. This structure of weight adjustable dumbbell, as shown in FIG. 1, is generally comprised of a short bar A having a plurality of pin holes A1 symmetrically spaced on two opposite ends thereof for releasably fastening different pairs of round weights by lock pins. This structure of weight adjustable dumbbell is still not satisfactory in use. One disadvantage of this structure of weight adjustable dumbbell is that the round weights may oscillate on the two opposite ends of the short bar as it is lifted or swung about in the hand for muscular exercise, causing a balancing problem. Another disadvantage of this structure of weight adjustable dumbbell is that the lock pins may disconnect from the short bar or be broken easily causing the round weights to suddenly displace from respective positions or drop from the short bar, and therefore an exercising accident may happen easily.

SUMMARY OF THE INVENTION

The present invention eliminates the aforesaid circumstances. It is therefore an object of the present invention to provide an adjustable dumbbell which can be conveniently adjusted to change its weight according to different requirements. It is another object of the present invention to provide an adjustable dumbbell which is easy to assemble. It is still another object of the present invention to provide an adjustable dumbbell which has means to lock the parts in place.

According to one aspect of the present invention, the adjustable dumbbell is comprised of a revolving shaft clamped with a clamping plate and coupled to a solid rod inserted in a tube, a catch pivotally connected to the tube at one end to hold down the solid rod, a cover sleeve sleeved on the tube, a guard adjustably fastened to the cover sleeve, two weights fastened to the tube at two opposite ends, two sockets respectively mounted on the weights, and two end caps respective fastened to the sockets to hold counter weights.

According to another aspect of the present invention, the cover sleeve has a plurality of annular grooves spaced around its peripheral wall, the guard has two opposite ends bent into two angle rods terminated in two loops adjustably fastened to either two annular grooves on the cover sleeve.

According to still another aspect of the present invention, the catch having a pin hole on an arched end pivotally fastened to a countersunk hole on a projecting block on one end of the tube by a headed lock pin and a retainer and turned to hook on the solid rod in holding it down.

According to still another aspect of the present invention, the clamping plate has inside flanges gradually raised from the inside surface thereof respectively fitted over gradually raised outside flanges on the revolving shaft. Therefore, turning the solid rod in one direction relative to the tube causes the outside flanges of the revolving shaft to stretch the inside flanges of the clamping plate outwards in stopping against the tube tightly; turning the solid rod in the reverse direction relative to the tube causes the clamping plate to be released from the solid rod for permitting the solid rod to be moved in and out of the tube.

BRIEF DESCRIPTION OF THE DRAWINGS

The foregoing and other objects, features and advantages of the present invention will be best understood from the following description, the appended claims and the accompanying drawings in which:

DETAILED DESCRIPTION OF THE PREFERRED EMBODIMENT

Figure 1:
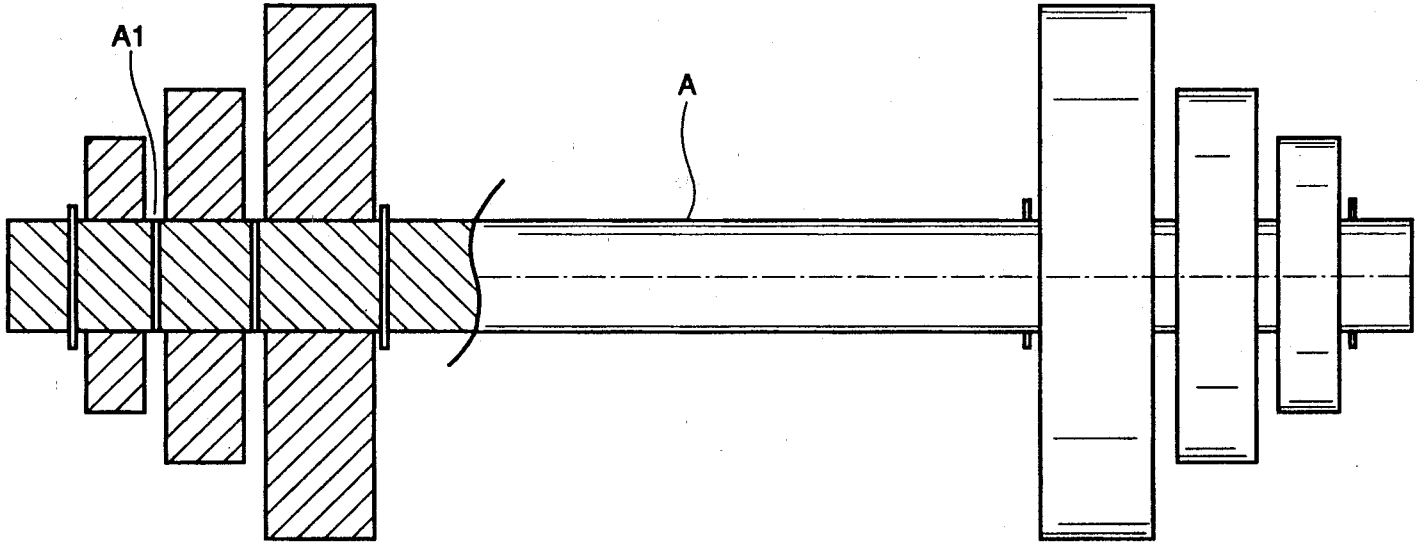
FIG. 1 is a sectional assembly view of a weight adjustable dumbbell according to the prior art.
Figure 2:
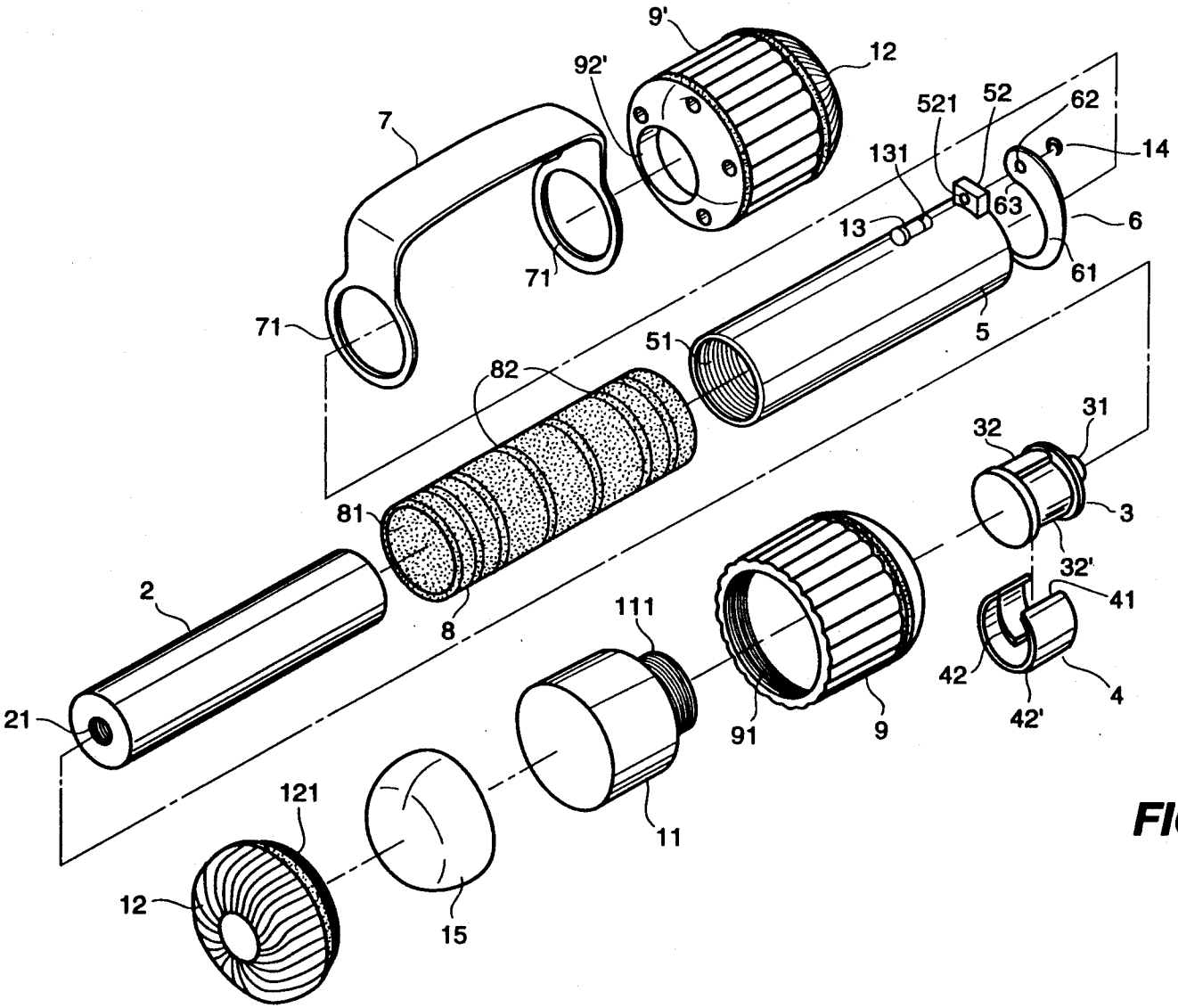
FIG. 2 is an exploded view of an adjustable dumbbell embodying the present invention.
Figures 3, 3A:
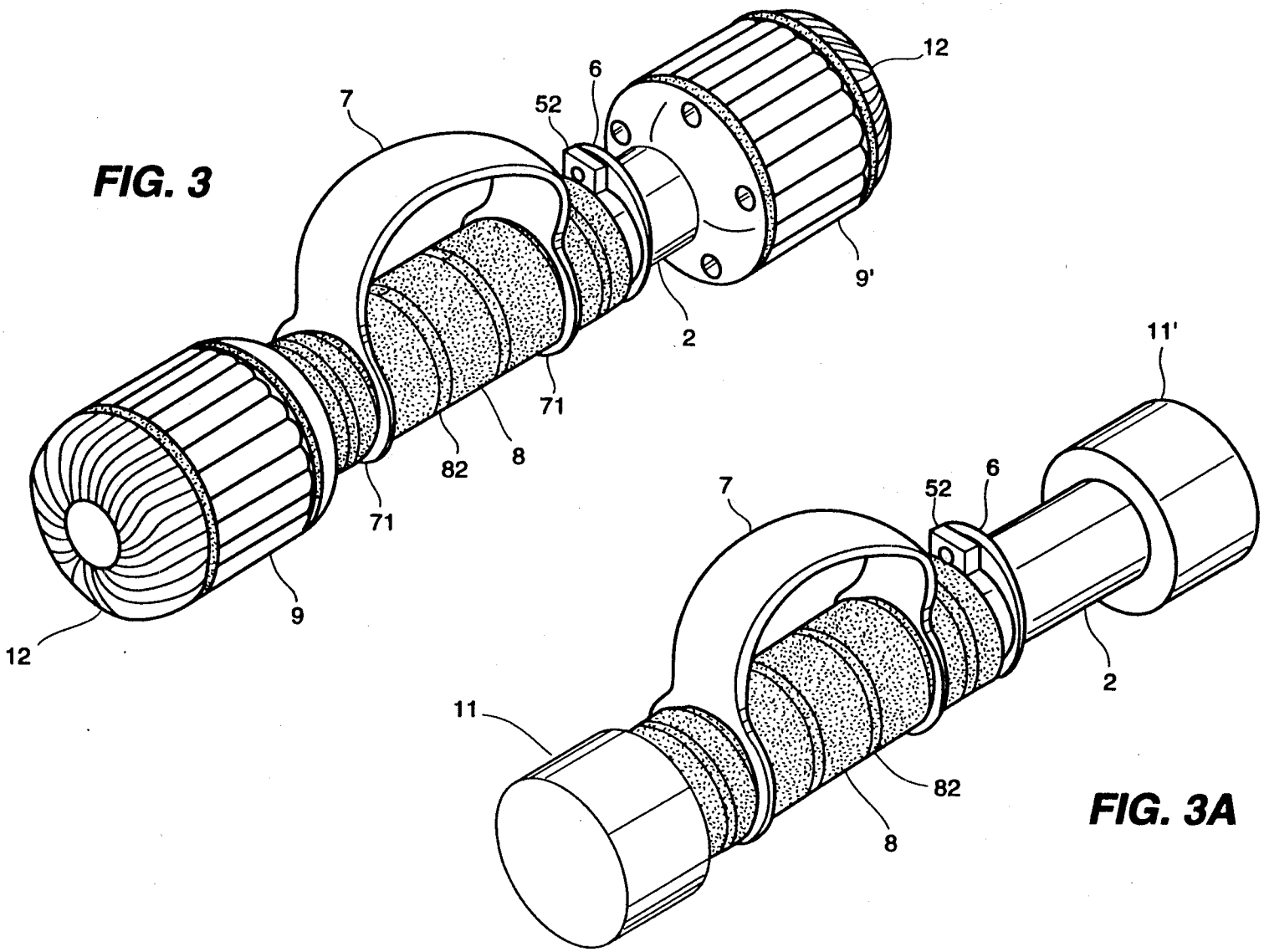
FIG. 3 is an elevational view of the adjustable dumbbell of FIG. 2.
FIG. 3A is another elevational view of the adjustable dumbbell of FIG. 2 showing the end caps and sockets removed.

Referring to FIGS. 2 and 3, an adjustable dumbbell as constructed in accordance with the present invention is generally comprised of a solid rod 2, a revolving shaft 3, a clamping plate 4, a tube 5, a catch 6, a guard 7, a cover sleeve 8, a first sockets 9 and a second socket 9', a first weight 11 and a second weight 11', two end caps 12, a headed pin 13, a retainer 14, two identical counter weights 15, and a coupling bolt 16.

The solid rod 2 has bolt holes 21,21' on two opposite end edges thereof. The revolving shaft 3 has a screw rod 31 at one end, and two gradually raised outside flanges 32,32' around the periphery thereof. The clamping plate 4 is shaped like a ring having two opposite ends spaced by an opening 41 and two gradually raised inside flanges 42,42' fitting the outside flanges 32,32' on the revolving shaft 3. The tube 5 has an inner thread 51 on one end thereof and a block 52 with countersunk hole 521 perpendicularly made on an opposite end thereof on the outside. The catch 6 has a pin hole 62 on an arched end 63 of a circularly curved hook 61 thereof. The guard 7 is made from an elongated flat plate having two opposite ends respectively bent downwards and inwards and terminated in loops 71. The cover sleeve 8 has a center hole 81 through its longitudinal axis and a plurality of annular grooves 82 spaced around the outside surface. The socket 9 or 9' is made in the shape of a socket having an inner thread 91 or 91' on one end and a center hole 92 or 92' on an opposite end longitudinally aligned with the inner thread 91 or 91', wherein the center hole 92 or 92' is relative smaller than the inner thread 91 or 91'. The weights 11, 11' are equal in weight. The first weight 11 has a screw rod 111 at one end. The second weight 11' has a countersunk hole 111' through the longitudinal axis thereof. The end caps 12 are identical, each having an outer thread 121 on one end. The headed pin 13 has an annular groove 131 around the periphery near the plain end thereof. The counter weights 15 are respectively made in the shape of a cone.

Figure 4:
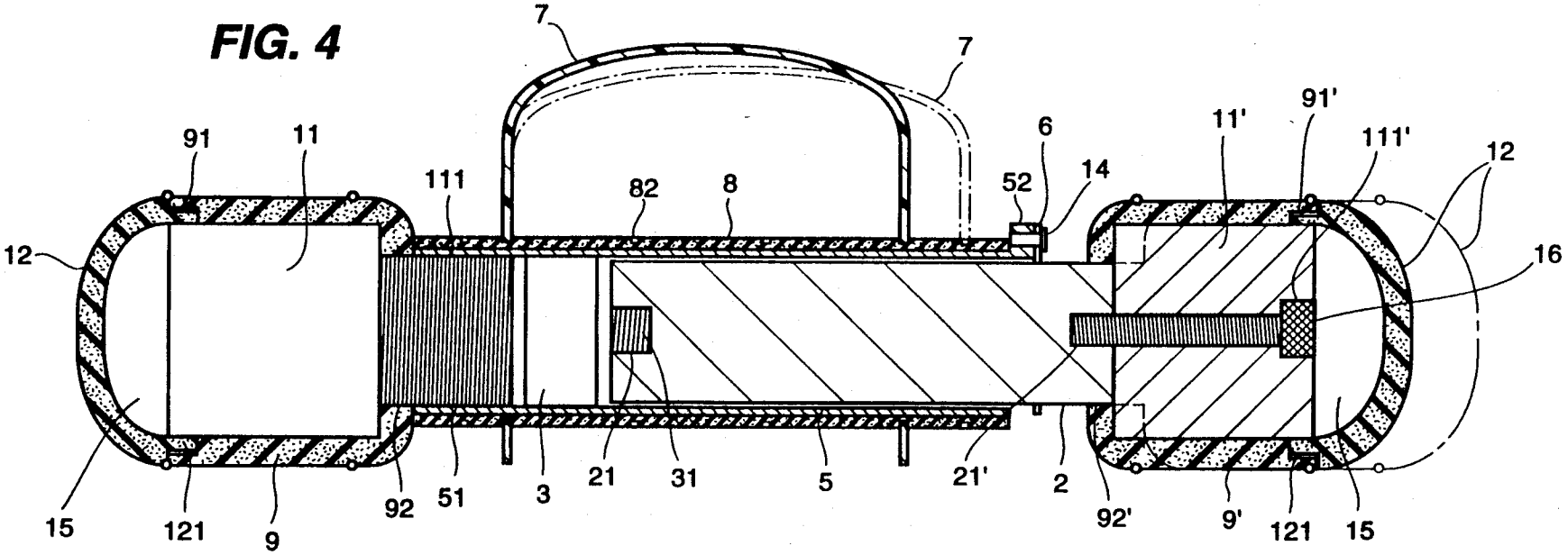
FIG. 4 is a sectional view of the adjustable dumbbell of FIG. 2 in longitudinal direction.
Figure 5A:
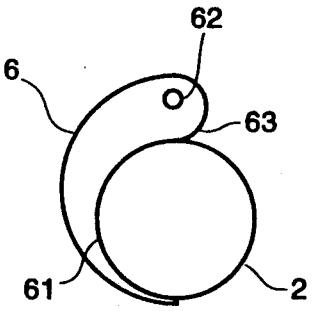
FIG. 5A illustrates the solid rod caught by the catch.
Figure 5B:
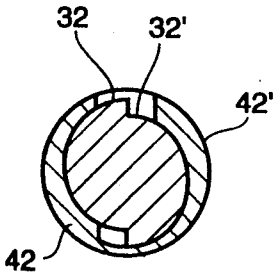
FIG. 5B illustrates the clamping plate in a relaxed state.
Figure 5C:
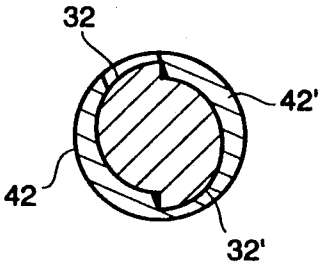
FIG. 5C illustrates the clamping plate stretched outward by the outside flanges of the revolving shaft.

Referring to FIGS. 3 and 4, the tube 5 is inserted into the center hole 81 through the cover sleeve 8 permitting the cover sleeve 8 to be stopped against the block 52, the loops 71 of the guard 7 are sleeved on the cover sleeve 8 and hooked on two annular grooves 82 thereof, then the headed pin 13 is inserted through the countersunk hole 521 on the block 52 and the pin hole 62 on the catch 6 and locked in place by fastening the retainer 14 to the annular groove 131 on the headed pin 13, and then the screw rod 31 of the revolving shaft 3 is threaded into the bolt hole 21 on one end of the solid rod 2 and the clamping plate 4 is clamped on the revolving shaft 3 with the inside flanges 42,42' respectively fitted over the outside flanges 32,32' of the revolving shaft 3, and then the screw rod 111 of the first weight 11 is inserted through the center hole 92 of the first socket 9 and threaded into the inner thread 51 on the tube 5, and then the second weight 11' is inserted into the second socket 9' for permitting the coupling bolt 16 to insert through the countersunk hole 111' on the second weight 11' and the center hole 92' on the second socket 9' and thread into the other bolt hole 21' on the solid rod 2, and then the outer thread 121 of each end cap 12 is respectively threaded into the inner thread 91 or 91' on either socket 9. A counter weight 15 may be respectively retained in either socket 9 or 9' by the respective end cap 12 to increase the weight of the dumbbell.

Referring to FIG. 4 and FIGS. 5A-5C again, the solid rod 2 is extended out of the tube 5 at a suitable distance (see the dotted line in FIG. 4) and turned in one direction to rotate revolving shaft 3 against the clamping plate 4, thereby causing the outside flanges 32,32' to stretch the inside flanges 42,42' outwards in stopping the outside surface of the clamping plate 4 against the inside surface of the tube 5 tightly. The hook 61 of the catch 6 is then hooked on the solid rod 2 to hold it down tightly. The guard 7 is then adjusted to the most suitable position over the center of gravity.

Referring to FIG. 3A, the sockets 9,9', the end caps 12 and the counter weights 15 may be removed from the dumbbell so that the dumbbell can be used as a block in exercising arm motion.

What is claimed is:

1. An adjustable dumbbell comprising:

a solid rod having bolt holes on two opposite end edges thereof;

a revolving shaft having a screw rod at one end threaded into the bolt hole on one end of said solid rod and two gradually raised outside flanges around a peripheral wall thereof;

a circular clamping plate clamped on said revolving shaft, having two opposite ends spaced by an opening and two gradually raised inside flanges fitted over said outside flanges of said revolving shaft respectively;

a tube sleeved on said circular clamping plate, said revolving shaft and said solid rod, having an inner thread on one end thereof and a block perpendicularly made on an opposite end thereof on the outside, said block having a countersunk hole;

a catch having a pin hole on an arched end pivotally fastened to the countersunk hole on said block of said tube by a pin and a retainer and releasably hooked on said solid rod;

a cover sleeve sleeved on said tube, said cover sleeve having a plurality of annular grooves spaced around an outside surface thereof;

a guard having two loops on two opposite ends thereof respectively sleeved on said cover sleeve and releasably fastened to two annular grooves on said cover sleeve;

a first weight attached to said tube at one end, said first weight having a screw rod at one end threaded into the inner thread on said tube;

a second weight attached to said tube at an opposite end, said second weight having a countersunk hole through a center axis thereof fastened to the bolt hole on the opposite end of said solid rod by a coupling bolt;

two sockets respectively mounted on said first and second weights, each socket having an inner thread on a respective outer end;

two counter weights respectively inserted into said sockets, each being made in the shape of a cone;

two end caps respectively fastened to said sockets to hold down said counter weights, each end cap having an outer thread respectively threaded into the inner thread on either socket; and wherein turning said solid rod in one direction relative to said tube causes the outside flanges of said revolving shaft to stretch the inside flanges of said clamping plate outwards in stopping against said tube tightly; turning said solid rod in the reverse direction relative to said tube causes said clamping plate to be released from said solid rod for permitting said solid rod to be moved in and out of said tube.

* * * * *